US005535283A

United States Patent [19]

Saruta et al.

[11] Patent Number: 5,535,283

[45] Date of Patent: Jul. 9, 1996

[54] ACTIVE NOISE ATTENUATING DEVICE

[75] Inventors: Susumu Saruta, Hirakata; Yasuyuki Sekiguchi, Takatsuki, both of Japan

[73] Assignee: Kabushiki Kaisha Toshiba, Kawasaki, Japan

[21] Appl. No.: 174,004

[22] Filed: Dec. 28, 1993

[30] Foreign Application Priority Data

Dec. 28, 1992 [JP] Japan ..... 4-349088

[51] Int. Cl.[6] ..... G10K 11/16

[52] U.S. Cl. ..... 381/71; 381/94

[58] Field of Search ..... 381/71, 94

[56] References Cited

U.S. PATENT DOCUMENTS 4,837,834 6/1989 Allie ..... 381/71
5,127,235 7/1992 Nakanishi et al. ..... 381/71
5,251,262 10/1993 Suzuki ..... 381/71
5,253,486 10/1993 Sugahara ..... 381/71
5,278,780 1/1994 Eguchi ..... 381/71
5,337,366 8/1994 Eguchi ..... 381/71

*Primary Examiner*—Edward L. Coles, Sr
*Assistant Examiner*—Jerome Grant, II
*Attorney, Agent, or Firm*—Cushman Darby & Cushman

[57] ABSTRACT

An active noise attenuating device applied to a draft duct of an air condition system including a microphone disposed in a propagation path of noise for detecting the noise, a loud speaker disposed in the noise propagation path, a control circuit for producing a control signal on the basis of the detection signal from the microphone, the control signal being supplied to the loud speaker so that the speaker produces an interference sound having the same amplitude as of the noise detected by the microphone and a phase opposite to the noise, at a control point in the noise propagation path, and a high pass filter for damping or cutting off a frequency component contained in the control signal and belonging to a low frequency range in which the loud speaker is unable to reproduce the interference sound.

14 Claims, 5 Drawing Sheets

ACTIVE NOISE ATTENUATING DEVICE

BACKGROUND OF THE INVENTION

1. Field of the Invention

This invention relates to an active noise attenuating device provided in a propagation path of noise for producing a sound having the same amplitude as that of the noise and a phase opposite to the noise, to cause a sound interference, thereby attenuating the noise.

2. Description of the Prior Art

An active noise attenuating device has recently been proposed for attenuating noise produced by an air conditioner and propagating along a draft duct thereof. The active noise attenuating device produces a sound having the same amplitude as that of the noise and a phase opposite to the noise to cause a sound interference in the draft duct, thereby actively attenuating the noise and reducing an amount of noise leaking out of the draft duct.

An active noise attenuating technique applied to the above-described device employs applied electronic techniques and particularly, an acoustic data processing circuit arrangement and acoustic interference. In this active noise attenuating technique, basically, a microphone is provided in the draft duct to detect the sound from a noise source, thereby converting the detected sound to a corresponding electrical signal. The electrical signal is processed into a signal by an operation unit. The signal is supplied to a loud speaker so that it produces an artificial sound having the same amplitude as of the noise and the phase opposite to the noise, at a control point and so that the artificial sound interferes with the noise at the control point.

An attenuation efficiency can be expected to amount to 10 dB or more in a low frequency band in the above-described device. Moreover, no pressure loss occurs in the above noise attenuation device. For example, when a concert hall is equipped with the above-described active noise attenuating device, noises produced from the draft ducts can be attenuated such that a better space can be provided for appreciation of music.

In employment of the active noise control in practice, characteristic variations due to aged deterioration of parts composing the signal system and due to an ambient temperature need to be coped with. For this purpose, an operational factor or acoustic transfer function of the operation unit is adjusted in accordance with variations in the noise attenuating performance of the device. More specifically, a monitoring microphone is provided for monitoring the noise attenuating effect of a loud speaker. Adaptive control means is also provided for controlling the operation unit. When the monitorial result is out of a predetermined allowable range, the adaptive control means changes the operational factor of the operation unit so that the monitorial result is within the allowable range. Consequently, the noise attenuation performance in the active noise control is maintained at its optimum in accordance with the characteristic variations. This control manner is referred to as "adaptive control."

FIG. 5 illustrates an example of the conventional active noise attenuating device as described above. A sound source microphone 2 for detecting noise, a loud speaker 3 producing an interference sound and a monitoring microphone are disposed along a noise propagation path in an air-conditioning draft duct 1. A detection signal generated by the microphone 2 is supplied via a low pass filter (LPF) 7 and an analog-to-digital (A/D) converter 8 to an input section of a finite impulse response (FIR) filter 6 serving as the operation unit in a control section 5 generating a control signal for producing the interference sound. The FIR filter 6 processes the detection signal from the microphone 2 by operation and generates a control signal, which signal is supplied to the loud speaker 3 via a digital-to-analog (D/A) converter 9, an LPF 10 and an amplifier 11. An adaptive filter 12 is provided for adjusting an operation factor of the FIR filter 6. The detection signal from the microphone 2 is supplied to the adaptive filter 12 via the LPF 7 and an A/D converter 8. Furthermore, a detection signal generated by the monitoring microphone 4 is supplied to the adaptive filter 12 via an LPF 13 and an A/D converter 14.

Generation of the control signal by the control section 5 will be described. The control section 5 processes the detection signal from the microphone 2 on the basis of the following characteristic:

$$G_{SO}=G_{SA}.G_{AO} \tag{1}$$

where $G_{AO}$ is an acoustic transfer characteristic between a point A indicative of the position of the loud speaker 3 and a point O indicative of the position of the monitoring microphone 4, $G_{SO}$ an acoustic transfer characteristic between a point S indicative of the sound source microphone 2 and the point O, and $G_{SA}$ an acoustic transfer characteristic between the point S and the point A. Then, a transfer characteristic G of the FIR filter 6 of the control section 5 needs to have an opposite phase with the acoustic transfer characteristic $G_{SA}$ between the points S and A. From the equation (1), the transfer characteristic G of the FIR filter 6 is obtained as follows:

$$G=-G_{SA}=-G_{SO}/G_{AO}\,. \tag{2}$$

Accordingly, the noise can be attenuated by the interference sound produced from the loud speaker 3 at the position of the monitoring microphone 4 when the transfer characteristic G of the FIR filter 6 is set at a value shown by the equation (2).

The signals from the microphones 2 and 4 are converted by the A/D converters 8 and 14 to digital signals respectively, which signals are supplied to the control section 5. These digital signals are processed by the control section 5. More specifically, high frequency components out of an objective noise frequency range are eliminated by the LPF 7 from the detection signal generated by the sound source microphone 2. The detection signal produced from LPF 7 is then sampled at a sampling frequency f and converted to a digital signal by the A/D converter 8. The sampling frequency f is set to a value twice as large as an upper limit frequency intended for noise attenuation or more so that a sampling theorem is satisfied.

In order that an interference sound having the same amplitude as of the noise and a phase opposite to it is produced, the FIR filter 6 processes the digitized detection signal indicative of the noise so that the amplitude and the phase of the detection signal are adjusted, thereby generating a control signal for production of the interference sound. The control signal is converted by the D/A converter 9 to an analog signal, which signal is supplied to LPF 10 eliminating higher harmonic alias components from the analog signal. The analog signal is then supplied via the amplifier 11 to the loud speaker 3. The interference sound produced from the loud speaker 3 interferes with the noise in the draft duct 1 to attenuate it.

The monitoring microphone 4 monitors the interference sound produced from the loud speaker 3 so that it is determined whether or not a sufficient attenuation effect is being achieved, thereby generating a detection signal. Based on the detection signal from the monitoring microphone 4, the adaptive filter 12 adjusts the operation factor of the FIR filter 6.

During the noise attenuation, the detection signal from the sound source microphone 2 is converted by the A/D converter 8 to the digital signal, which signal is supplied to both the FIR filter 6 and the adaptive filter 12. Furthermore, the digital signal is supplied to the adaptive filter 12 via the A/D converter 15 from the monitoring microphone 4. Based on these two digital signals, the adaptive filter 12 sets the operation factor of the FIR filter 6, for example, by a least-mean square (LMS) algorithm, so that the level of the signal generated by the monitoring microphone 4 is rendered the minimum or so that an amount of noise attenuated becomes the maximum. Thus, an adaptive control is performed so that the active noise control of the FIR filter 6 is usually executed efficiently.

In the above-described noise attenuation device, the system linearity is one of factors for determining the attenuation effect. A coherence function represented as a function of frequency is one of indexes of the system linearity. The attenuation effect of the system can be estimated by measuring the coherence function.

This coherence function serves to evaluate the system transfer function. Since an output is determined only by an input when the transmission system for a signal indicative of an measured object is linear and there is no noise contamination in the system. Accordingly, the coherence function takes the value of "1." On the other hand, the coherence function takes the value smaller than "1" when the signal transmission system is not linear or when there is some noise contamination in the system. FIG. 6 shows the relationship between changes in the coherence value and variations of an amount of noise attenuated. As understood from FIG. 6, the noise can be completely attenuated when the coherence value of the active noise attenuating device is "1" in a specified frequency range under the condition that the interference sound can be produced desirably. However, the noise can be attenuated only by 20 dB when the coherence value is reduced to 0.9. The reproducing performance of the loud speaker 3 reproducing the interference sound is one of factors reducing the coherence value or influencing the linearity of the system. More specifically, a lower limit of the frequency band of the sound to be reproduced by a loud speaker generally ranges 40 to 50 Hz. A wavelength of the reproduced sound exceeds the diameter of a cone composing the loud speaker when the frequency of the input signal is at 40 to 50 Hz or below. Although the cone of the loud speaker is caused to move back and forth to vibrate air in response to the input signal, a sound cannot be reproduced because the efficiency of converting the electrical signal to vibration is too low.

In the vibration characteristic of the cone of the loud speaker 3, it tends to vibrate with a large amplitude when the frequency of the signal input to the loud speaker 3 belongs to the above-described low frequency band and the amplitude of the signal is reduced as the frequency of the input signal is increased. Accordingly, the cone of the loud speaker is caused to unnecessarily move back and forth when an unreproducible low frequency signal is input to the loud speaker. Consequently, the vibration of the cone in response to a simultaneously input high frequency signal is prevented and the loud speaker cannot reproduce the sound with fine linearity. Thus, the characteristic of the loud speaker 3 is rendered nonlinear when the loud speaker 3 is supplied with the interference sound signal containing the unreproducible low frequency, so that the coherence value is reduced and an expected noise attenuation effect cannot be achieved.

SUMMARY OF THE INVENTION

Therefore, an object of the present invention is to provide a noise attenuation device wherein the linear output characteristic of the loud speaker producing the interference sound can be maintained so that the noise attenuating effect expected from the coherence function is not reduced.

To achieve the object, the present invention provides an active noise attenuating device comprising a microphone provided in a propagation path of noise for detecting the noise, thereby generating a detection signal and a loud speaker provided in the propagation path of the noise. Control means is provided for producing a control signal on the basis of the detection signal supplied thereto from the microphone. The control signal is supplied to the loud speaker so that the speaker produces an interference sound having the same amplitude as of the noise detected by the microphone and a phase opposite to the noise at a control point in the noise propagation path. A high pass filter is connected to a path between the control means and the loud speaker for damping or cutting off a frequency component at which a coherence value indicative of the linearity of input and output characteristics in accordance with a frequency in the control means is rapidly reduced, or below, out of a frequency component contained in the control signal and belonging to a low frequency range in which the loud speaker is unable to reproduce the interference sound.

The high pass filter damps or cutting off the frequency component at which the coherence value indicative of the linearity of input and output characteristics in accordance with the frequency in the control means is rapidly reduced, or below, out of the frequency component contained in the control signal for producing the interference sound and belonging to a low frequency range in which the loud speaker is unable to reproduce the interference sound. The loud speaker is thus driven mainly by the sound reproducible frequency component. Consequently, since the occurrence of distortion of the linear output characteristic of the loud speaker is prevented, the interference sound desirably reproducing the reproducible frequency component of the control can be produced and the reduction of the coherence value and accordingly, the reduction of the noise attenuation effect can be prevented. Furthermore, a phase lag usually occurs in the vicinity of the cut-off frequency of the high pass filter. In view of the phase lag, signal processing needs to be performed at a high speed. However, the cut-off frequency of the high pass filter is lower than the lower limit of the frequency reproduced by the loud speaker in the above described arrangement. Consequently, means for processing signals at a high speed is not necessitated.

The above-described active noise attenuating device may be provided with adaptive control means so that an adaptive control is executed. In this arrangement, too, the same effect can be achieved as described above. Furthermore, the adaptive control means may be arranged to perform the function of the above-described high pass filter as well as its function of the adaptive control.

Other objects of the invention will become obvious upon understanding of the illustrative embodiments about to be described. Various advantages not referred to herein will occur to those skilled in the art upon employment of the invention in practice.

BRIEF DESCRIPTION OF THE DRAWINGS

The embodiments of the invention will be described with reference to the accompanying drawings, in which.

DESCRIPTION OF THE PREFERRED EMBODIMENTS

A first embodiment of the present invention will be described with reference to FIGS. 1 to 3 of the accompanying drawings. In the first embodiment, the active noise attenuating device of the invention is applied to a draft duct of an air conditioning system and performs an adaptive control as will be described later.

Figure 1:
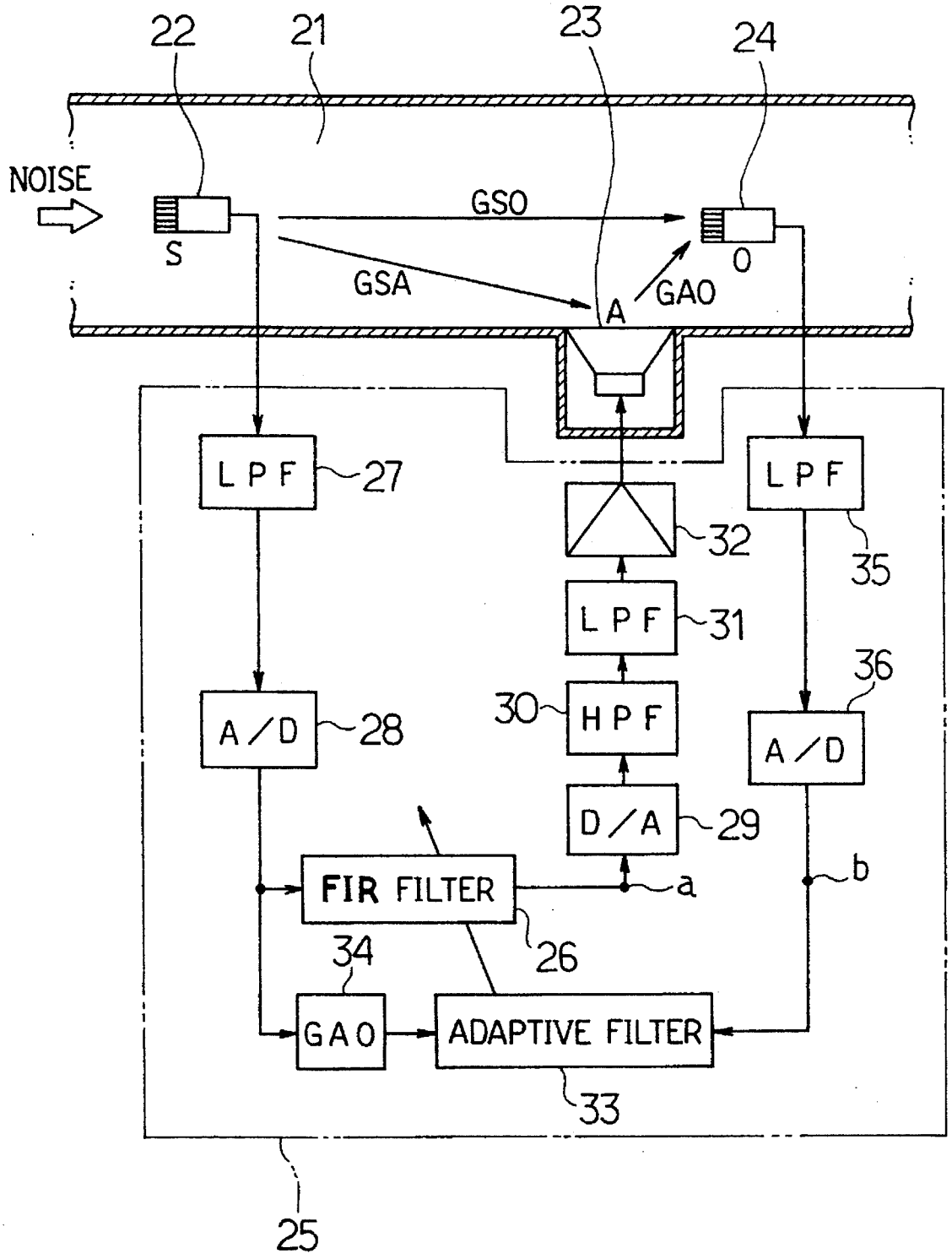
FIG. 1 is an electrical block diagram showing the active noise attenuating device of a first embodiment in accordance with the present invention.
Figure 2:
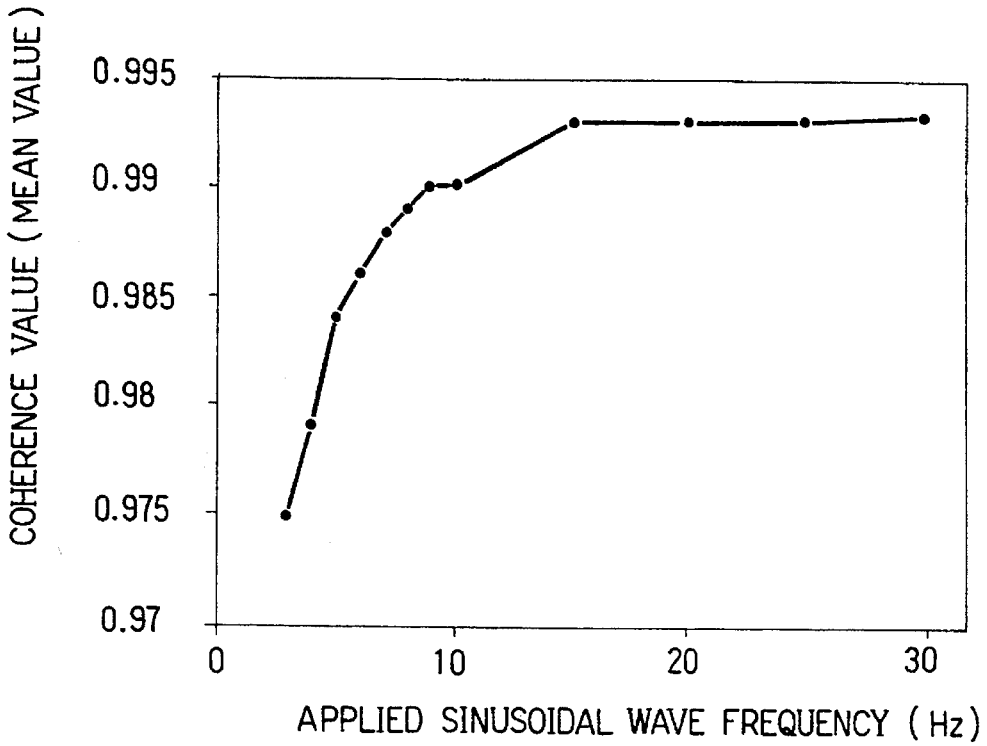
FIG. 2 is a graph showing the relationship between an amount of noise reduced and the coherence value when the low frequency component in a noise attenuatable frequency range is applied to the loud speaker.

Referring to FIG. 1, the air conditioning system (not shown) is provided at the left hand of a draft duct 21. Conditioned air from the air conditioning system is supplied through the duct 21 to the right, as viewed in FIG. 1. The draft duct 21 serves as a propagation path of noise produced from the air conditioning system as well as the flow path of the air. The duct 21 has a generally 50 centimeters square section, for example.

A sound source microphone 22 is disposed in the draft duct 21 for detecting the noise propagating in it, thereby generating a detection signal indicative of the detected noise. A loud speaker 23 is disposed downstream of the microphone 22 or at a predetermined position in the right of it in the duct 21, as viewed in FIG. 1. The loud speaker 23 produces an interference sound interfering with the noise, as will be described later. Furthermore, a monitoring microphone 24 is disposed in the vicinity of the loud speaker 23 at the right hand thereof. The monitoring microphone 24 detects the interference sound produced from the loud speaker 23 for the purpose of evaluating an effect of noise attenuation, thereby generating a detection signal indicative of the detected interference sound.

The detection signals generated by the microphones 22 and 23 are supplied to a control circuit 25, which generates a control signal for production of the interference sound on the basis of the detection signals supplied thereto. The control signal is supplied to the loud speaker 23. More specifically, the detection signal generated by the microphone 22 is supplied via an LPF 27 and an A/D converter 28 to an input section of an FIR filter 26 serving as control means. The FIR filter 26 having a transfer characteristic G performs an operation to process the input signal by filtering to thereby generate the control signal, as will be described later. The control signal is supplied to the loud speaker 23 via a D/A converter 29, HPF 30 serving as adjusting means, LPF 31 and an amplifier 32 in turn.

The above-mentioned LPF 27 serves as an anti-alias filter allowing a frequency component up to about 800 Hz (upper limit) to pass therethrough with respect to the detection signal supplied thereto from the microphone 22. The A/D converter 28 samples the input signal at a sampling frequency f (2 kHz, for example) twice as high as the upper limit (800 Hz) of the pass frequency band of LPF 27 or above, thereby converting the input signal to a digital signal. The sampling frequency f is set to satisfy a sampling theorem for the sound to be attenuated whose frequency ranges in a frequency band from 50 to 350 Hz. LPF 31 also serves as the anti-alias filter and cuts off an alias component of higher harmonics contained in an analog signal obtained by the D/A converter 29.

A coherence value of the control system rapidly decreases in a frequency band of 10 Hz or below. HPF 30 is then set to cut off a frequency component at 10 Hz or below in a frequency band of 40 Hz or below in which frequency band sound cannot be reproduced by the loud speaker 23.

An adaptive filter 33 is provided for adjusting an operational factor of the FIR filter 26. A digital signal generated by the A/D converter 28 is supplied to the adaptive filter 33 via a digital filter 34 having a transfer characteristic $G_{AO}$. Furthermore, the detection signal generated by the monitoring microphone 24 is supplied to the adaptive filter 33 via LPF 35 and an A/D converter 36. LPF 35 serves as the anti-alias filter in the same manner as LPF 27. The A/D converter 36 is set at the same sampling frequency as set in the A/D convert 28. A transfer characteristic $G_{AO}$ of the digital filter 34 is based on a previously measured characteristic with respect to a path from a point a indicative of an output of the FIR filter 26 to a point b indicative of an output terminal of the A/D converter 36 via the D/A converter 29, HPF 30, LPF 31, the amplifier 32, the loud speaker 23, the duct 21, the microphone 24, LPF 35 and the A/D converter 36 sequentially in the condition that no noise is produced.

The operation of the active noise attenuating device will now be described. The frequency band of the noise to be attenuated will first be described. The draft duct 21 is formed to have a 50 centimeters square section, as described above. In view of its geometrical dimensions, an upper limit acoustic frequency propagating as a plane wave in the duct 21 is about 350 Hz. Accordingly, sound whose frequency is above 350 Hz cannot become a plane wave and decays with propagation. As a result, the frequency band of the noise to be attenuated is set to have its upper limit of about 350 Hz.

The control manner for the active noise attenuation will be described. The FIR filter 26 having the transfer characteristic G performs an operation to process the input signal by filtering as follows. The above-described relational expression (1), $G_{SO}=G_{SA}\cdot G_{AO}$, can be obtained where $G_{AO}$ is an acoustic transfer characteristic between a point A indicative of the position of the loud speaker 23 and a point O indicative of the position of the monitoring microphone 24, $G_{SO}$ an acoustic transfer characteristic between a point S indicative of the sound source microphone 22 and the point O, and $G_{SA}$ an acoustic transfer characteristic between the point S and the point A. Accordingly, the required transfer characteristic G of the FIR filter 26 needs to have an opposite phase with the above-described transfer characteristic $G_{SA}$ and is obtained from the above relational expression (2), $G=-G_{SA}=-G_{SO}/G_{AO}$. The transfer characteristic G of the FIR filter 26 is set on the basis of the results of previous measurement.

The sound source microphone 22 detects, at the point S, the noise propagating from the noise source through the duct 21, thereby generating a detection signal. The detection signal is supplied to LPF 27, which cuts off the high frequency component (alias component) of the detection signal, which high frequency component is in the attenuated frequency band or above. The signal generated by LPF 27 is then sampled at a sampling frequency f (2 kHz, for example) by the A/D converter 28 to be thereby converted to a digital signal. The digital signal is then supplied to the FIR filter 26 having the transfer characteristic G performs the operation to process the input digital signal, thereby generating the control signal for production of the interference sound.

The control signal is supplied to the D/A converter 29, which converts it to a corresponding analog signal. The analog signal is supplied to HPF 30. The low frequency component of 10 Hz or below contained in the analog signal rapidly decreases the coherence value. Then, HPF 30 cuts off the very low frequency component in the frequency band of 40 Hz or below in which frequency band sound cannot be reproduced by the loud speaker 23. Furthermore, LPF 31 cuts off the higher harmonic alias component contained in the analog signal supplied from HPF 30. Then, the signal is supplied to the loud speaker 23, which produces interference sound.

The cut-off frequency of HPF 30 is determined to be 10 Hz as described above. This determination is based on the results of measurement made by the inventors. That is, with reference to FIG. 2, the loud speaker 23 is supplied with random noise signals in the range up to 350 Hz, which range corresponds to the frequency range of the noise to be attenuated. The loud speaker 23 is further supplied with sinusoidal wave signals in the range of 3 to 30 Hz, which range corresponds to a frequency band of the sound which cannot be reproduced by the loud speaker 23. FIG. 2 shows the mean coherence values in the range up to 350 Hz in these cases. The measurement of the coherence values is based on the input signals of the loud speaker 23 and output signals of a measurement microphone disposed in front of the loud speaker 23. As understood from FIG. 2, the coherence value of the loud speaker 23 starts to decrease when the sinusoidal wave signal having the frequency of 15 Hz or below is supplied to it, and the coherence value rapidly decreases when the frequency of the sinusoidal wave signal supplied to the loud speaker 23 is 10 Hz or below.

Figure 3:
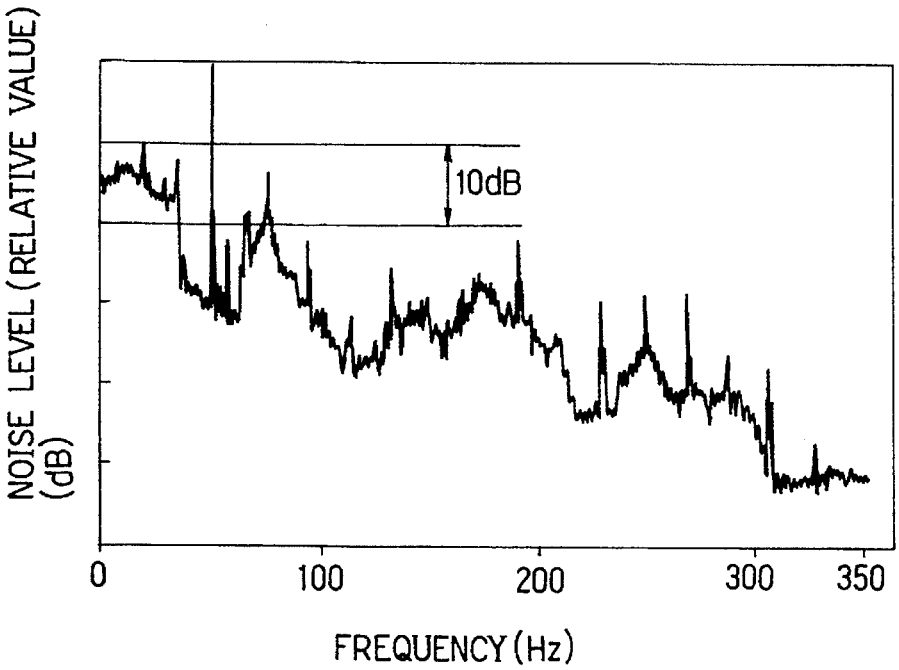
FIG. 3 is a graph showing the result of frequency analysis of the noise to be attenuated.

FIG. 3 shows the result of frequency analysis of the noise actually propagating through the duct 21. As understood from FIG. 3, the noise level is raised as the frequency component in the interference sound is cut off by HPF 30 such that distortion in the linear characteristic of the loud speaker 3 can be reduced.

The interference sound produced from the loud speaker 23 has, at the point O indicative of the position of the microphone 24, the same amplitude as that of the noise having propagated through the duct 21 and a phase opposite to that of the noise or out of phase substantially by 180 degrees with the noise. Consequently, the interference sound interferes with the noise such that a so-called acoustic wall is provided in the duct. Propagation of the noise downstream of the point O can be prevented by the acoustic wall. Furthermore, since the very low frequency component of the interference sound is cut off by HPF 30, the linearity of the loud speaker 23 can be prevented from being distorted by the interference sound signal supplied thereto. Thus, the reduction of the coherence value can be prevented. Consequently, the noise reduction of 10 dB or more can be achieved in the objective frequency band in the draft duct 21 in comparison with the above-described very low frequency component.

An adaptive control will now be described. In the adaptive control, the operational factor of the FIR filter 26 is adjusted so that the above-described active noise control can be performed in its optimum mode. The sound detected by the monitoring microphone 24 would theoretically approximate to zero while the noise attenuation control is being performed in the duct 21 on the basis of the control signal generated by the FIR filter 26. Actually, however, the temperature and the air flow speed vary depending upon the control state of the air conditioning system. The acoustic transfer characteristic in the duct 21 varies accordingly such that a theoretical noise attenuation cannot be achieved. The adaptive filter 33 is provided for changing the operational factor of the FIR filter 26 in order that the amount of noise attenuated is prevented from being reduced with the variation of the acoustic transfer characteristic in the duct 21 during the active noise control. The monitoring microphone 24 detects the sound having reached the point O in the duct 21, thereby generating a detection signal indicative of the detected sound. The detection signal is supplied to the adaptive filter 33 via LPF 35 and the A/D converter 36. More specifically, the control signal generated by the FIR filter 26 is filtered via the circuit section between points a and b in FIG. 1, the circuit section having the transfer characteristic $G_{AO}$. The filtered signal is supplied to the adaptive filter 33. Furthermore, the digital signal supplied from the A/D converter 28 to the FIR filter 26 is also supplied to a digital filter 34 having the transfer characteristic $G_{AO}$. The adaptive filter 33 is also supplied with a digital signal obtained by filtration of a digital filter 34. Based on these two input signals, the adaptive filter 33 adjusts the operational factor of the FIR filter 26 using a well known least-mean-square (LMS) algorithm.

According to the above-described embodiment, HPF 30 is provided at the output stage of the FIR filter 26. HPH 30 cuts off the very low frequency component of 10 Hz or below contained in the control signal generated for production of the interference sound. The very low frequency component which cannot be reproduced as sound by the loud speaker 23 is removed from the signal supplied to it. Consequently, the linearity of the loud speaker 23 can be prevented from being distorted by the interference sound signal supplied thereto. Thus, the active noise attenuation can be performed without reduction of the noise attenuation effect.

Furthermore, the cut-off frequency of HPF 30 is set at 10 Hz in view of the lower limit of 40 to 50 Hz of the objective frequency range to be attenuated by the active control. The objective frequency range can be prevented from being influenced by the time lag caused in the vicinity of the cut-off frequency by HPF 30. Consequently, means for processing signals at a high speed is not necessitated.

Although HPF 30 is independently provided as the adjusting means in the foregoing embodiment, it may be combined with LPF 31 at the subsequent stage into a band pass filter (BPF). Furthermore, the adjusting means may be a digital filter instead of the above-described analog filter.

Figure 4:
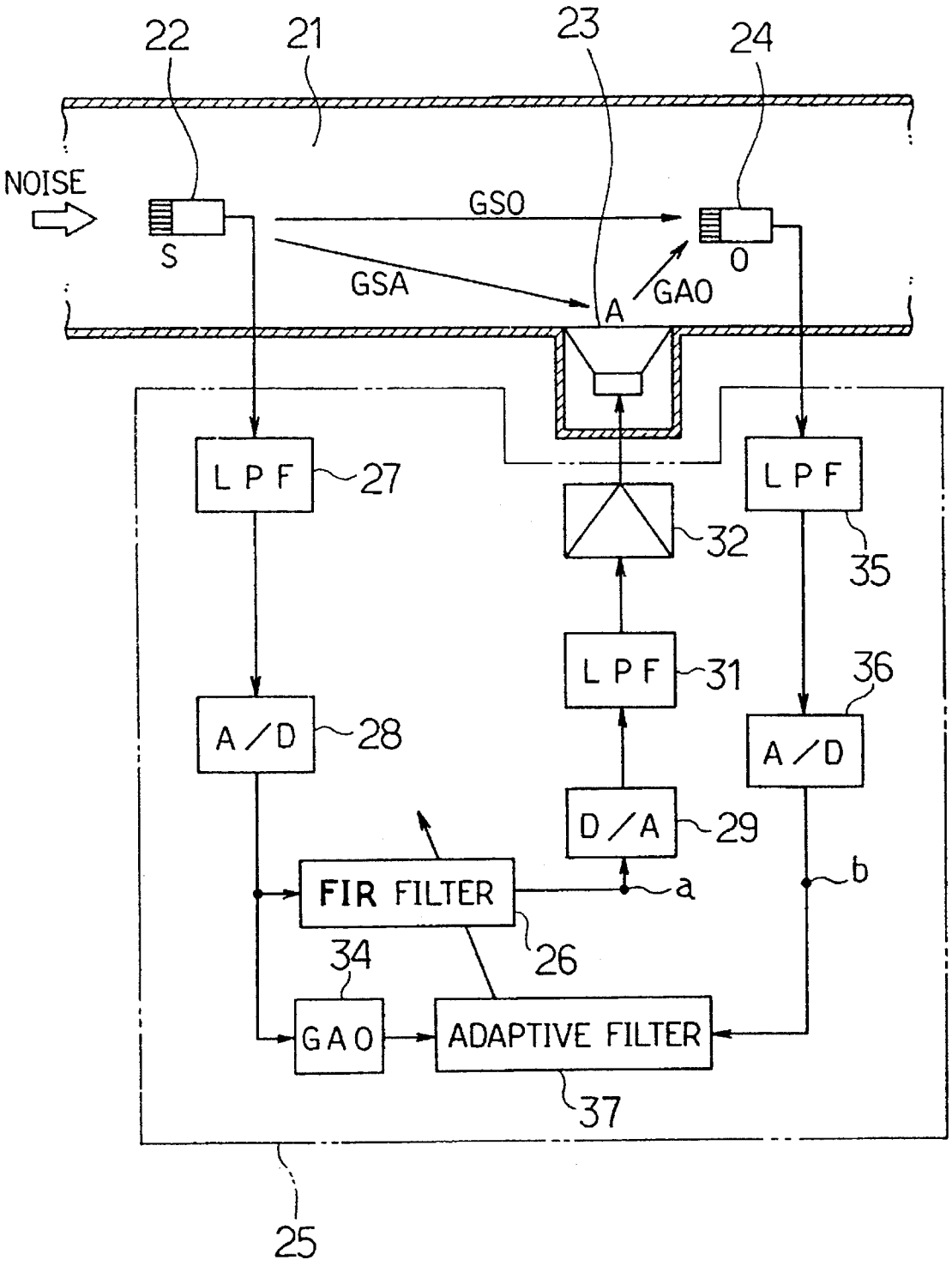
FIG. 4 is a view similar to FIG. 1 showing a second embodiment of the invention.
Figure 5:
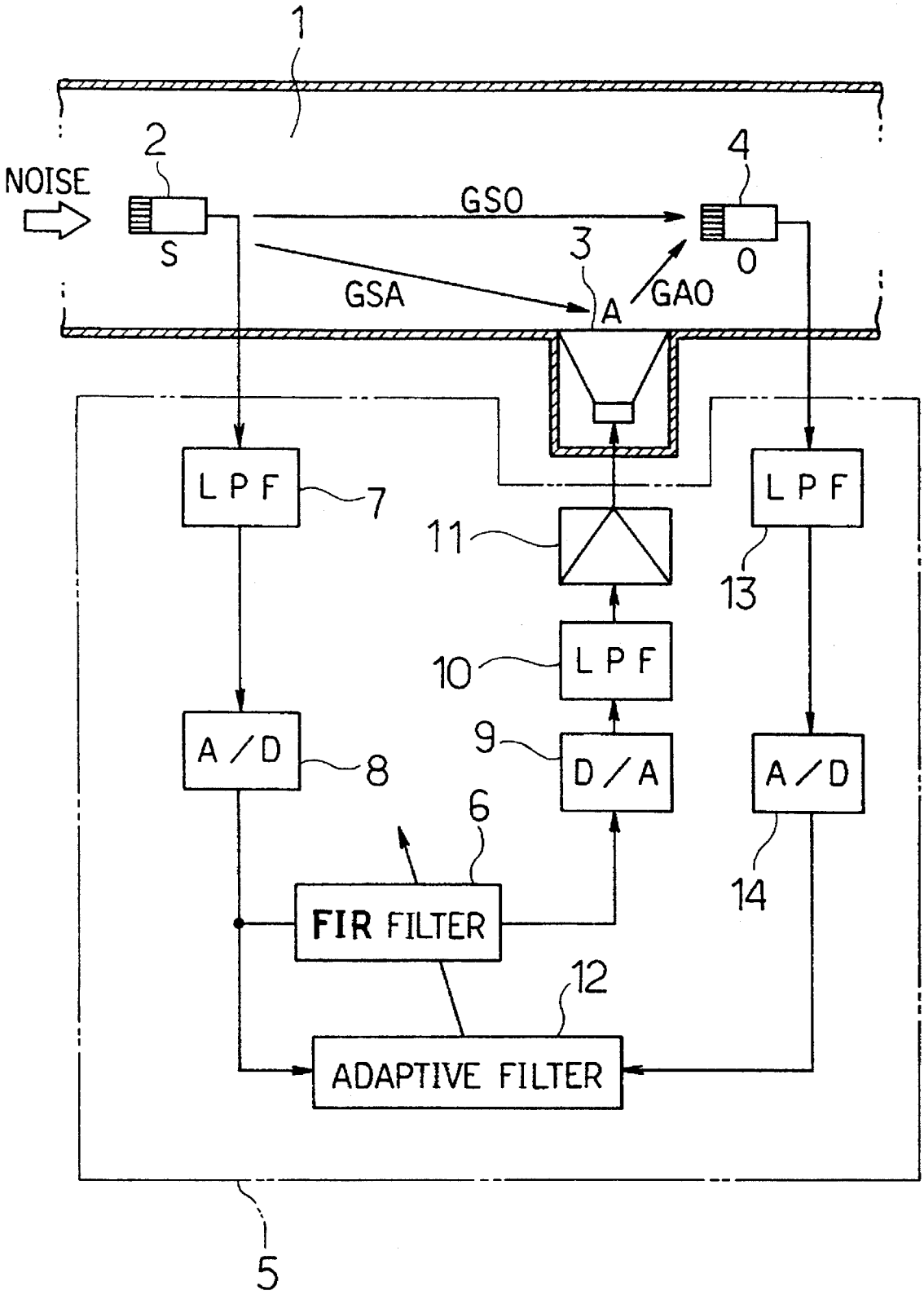
FIG.5 (PRIOR ART)
FIG. 5 is a view similar to FIG. 1 showing a conventional circuit arrangement.
Figure 6:
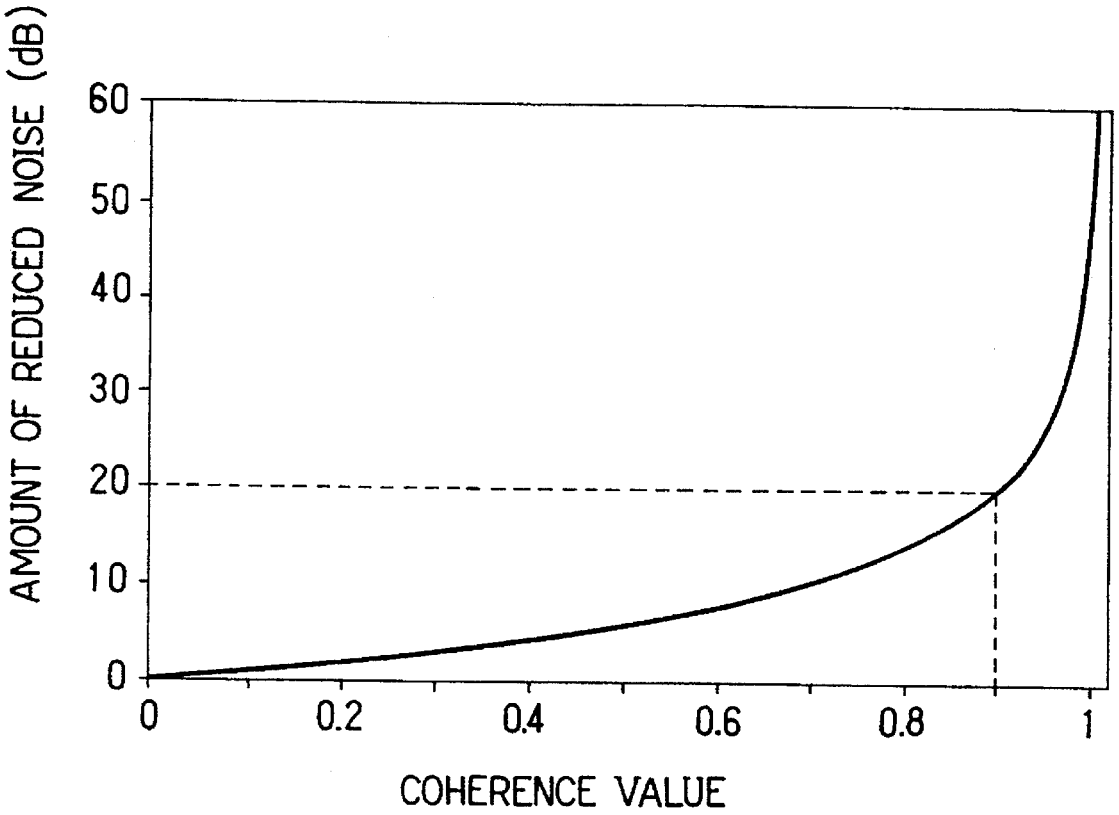
FIG. 6 (PRIOR ART)
FIG. 6 is a graph showing the relationship between the coherence value and the amount of reduced noise.

FIG. 4 shows a second embodiment of the invention. HPF 30 employed in the first embodiment is eliminated and an adaptive filter 37 is provided instead of the adaptive filter 33. In obtaining the operational factor, the adjusting filter 37 is arranged to lower a filter gain of the frequency component of 10 Hz or below. Thus, the adaptive filter 37 has the functions of HPF 30 and the adaptive filter 33. In the second embodiment, too, the low frequency signal which cannot be reproduced as sound by the loud speaker is not supplied to it. The noise attenuation can be performed with the linearity of the loud speaker maintained. Consequently, the coherence value is not decreased and the noise attenuation can be performed without reduction of its effect.

The foregoing disclosure and drawings are merely illustrative of the principles of the present invention and are not to be interpreted in a limiting sense. The only limitation is to be determined from the scope of the appended claims.

We claim:

1. An active noise attenuating device comprising:

a microphone provided in a propagation path of a noise which detects the noise and generates a detection signal;

a loudspeaker provided in the propagation path of the noise;

control means for producing a control signal on the basis of the detection signal supplied by the microphone, the control signal being supplied to the loudspeaker so that the loudspeaker produces an interference sound having the same amplitude as the noise detected by the microphone and a phase opposite to the noise at a control point in the noise propagation path; and a high pass filter connected in the path of the control signal between the control means and the loudspeaker, the high pass filter having a cut-off frequency within a low frequency range that the loudspeaker is unable to reproduce and which corresponds to a frequency component of the control signal at which a coherence value is rapidly reduced, the coherence value indicating linearity between input and output of the active noise attenuating device.

2. An active noise attenuating device according to claim 1, wherein the propagation path is a draft duct.

3. An active noise attenuating device according to claim 1, wherein the control means comprises:

a finite impulse response (FIR) filter;

an analog-to-digital (A/D) converter located in an input section of the FIR filter; and a digital-to-analog (D/A) converter located in an output section of the FIR filter, the control means producing the control signal using digital signal processing.

4. An active noise attenuating device according to claim 3, wherein the control means further comprises a low pass filter located in an input section of the A/D converter, the low pass filter allowing a frequency component half a sampling frequency of the A/D converter or less to pass therethrough.

5. An active noise attenuating device according to claim 3, wherein the control means further comprises a low pass filter is located in an output section of the D/A converter for cutting off a harmonic component.

6. An active noise attenuating device according to claim 5, wherein the high pass filter comprises a band pass filter also serving as the low pass filter provided in the D/A converter.

7. An active noise attenuating device comprising:

a first microphone provided in a propagation path of a noise which detects the noise and generates a detection signal;

a loudspeaker provided in the propagation path of the noise;

control means for producing a control signal on the basis of the detection signal supplied by the first microphone, the control signal being supplied to the loudspeaker so that the loudspeaker produces an interference sound having the same amplitude as the noise detected by the first microphone and a phase opposite to the noise at a control point in the noise propagation path;

a high pass filter connected in the path of the control signal between the control means and the loudspeaker, the high pass filter having a cut-off frequency within a low frequency range that the loudspeaker is unable to reproduce and which corresponds to a frequency component of the control signal at which a coherence value is rapidly reduced, the coherence value indicating linearity between input and output of the active noise attenuating device;

a second microphone provided in the vicinity of the control point in the noise propagation path, the second microphone monitoring an amount of noise attenuated by application of the interference sound; and adaptive control means for controlling the control means by compensating an operational factor thereof in correspondence with the amount of noise attenuated by application of the interference sound on the basis of the detection signals from the respective first and second microphones.

8. An active noise attenuating device according to claim 7, wherein the propagation path is a draft duct.

9. An active noise attenuating device according to claim 7, wherein the adaptive control means comprises:

a digital filter having a transfer function equal to an acoustic transfer characteristic of a circuit path between the loudspeaker producing the interference sound and the second microphone detecting the interference sound, the digital filter filtering the detection signal from the first microphone;

an analog-to-digital converter for converting the detection signal from the second microphone to a corresponding digital signal; and an adaptive filter for obtaining compensation for an operational factor of the control means.

10. An active noise attenuating device according to claim 9, wherein the control means further comprises a low pass filter located in an input section of the A/D converter, the low pass filter allowing a frequency component half a sampling frequency of the A/D converter or less to pass therethrough.

11. An active noise attenuating device according to claim 7, wherein the control means comprises:

a finite impulse response (FIR) filter;

an analog-to-digital (A/D) converter located in an input section of the FIR filter; and a digital-to-analog (D/A) converter located in an output section of the FIR filter, the control means producing the control signal using digital signal processing.

12. An active noise attenuating device according to claim 11, wherein the control means further comprises a low pass filter located in an input section of the A/D converter, the low pass filter allowing a frequency component half a sampling frequency of the A/D converter or less to pass therethrough.

13. An active noise attenuating device according to claim 11, wherein the control means further comprises a low pass filter located in an output section of the D/A converter for cutting off a harmonic component.

14. An active noise attenuating device according to claim 13, wherein the high pass filter comprises a band pass filter also serving as the low pass filter provided in the D/A converter.

* * * * *